US008402959B1

(12) United States Patent
Nungester

(10) Patent No.: US 8,402,959 B1
(45) Date of Patent: Mar. 26, 2013

(54) MAGNETIC FORCE FEED PROJECTILE FEEDER DRIVE MECHANISM

(75) Inventor: Gregory Nungester, Asbury, NJ (US)

(73) Assignee: Kee Action Sports I LLC, Sewell, NJ (US)

( * ) Notice: Subject to any disclaimer, the term of this patent is extended or adjusted under 35 U.S.C. 154(b) by 197 days.

(21) Appl. No.: 12/407,443

(22) Filed: Mar. 19, 2009

Related U.S. Application Data

(60) Provisional application No. 61/037,819, filed on Mar. 19, 2008.

(51) Int. Cl.
*F41B 11/02* (2006.01)

(52) U.S. Cl. ..... 124/51.1

(58) Field of Classification Search ..... 124/51.1
See application file for complete search history.

(56) References Cited

U.S. PATENT DOCUMENTS

| | | | |
|---|---|---|---|
| 1,743,576 | A | 1/1930 | Smith |
| 1,867,513 | A | 7/1932 | Lahti |
| 2,064,888 | A | 6/1935 | Dickinson |
| 2,338,984 | A | 1/1944 | Van Horn et al. |
| 2,451,521 | A | 10/1948 | Uglum |
| 2,568,432 | A | 9/1951 | Cook |
| RE23,951 | E | 2/1955 | Graham |
| 2,716,973 | A | 9/1955 | Desi |
| 2,900,972 | A | 8/1959 | Marsh et al. |
| 3,089,476 | A | 5/1963 | Wolverton |
| 3,134,301 | A | 5/1964 | Even |
| 3,273,553 | A | 9/1966 | Doyle |
| 3,410,453 | A | 11/1968 | Lawrence |
| 3,630,118 | A | 12/1971 | Stoner |
| 3,724,437 | A | 4/1973 | Halstead |
| 3,745,687 | A | 7/1973 | Koon, Jr. |
| 3,766,901 | A | 10/1973 | Cleary et al. |
| 3,777,732 | A | 12/1973 | Holloway et al. |
| 3,814,283 | A | 6/1974 | Cioth |
| 3,894,657 | A | 7/1975 | Eckmayr |
| 3,930,486 | A | 1/1976 | Kahelin |
| 3,978,841 | A | 9/1976 | Yarur et al. |
| 3,990,426 | A | 11/1976 | Stokes |

(Continued)

FOREIGN PATENT DOCUMENTS

| | | |
|---|---|---|
| DE | 876370 | 5/1953 |
| DE | 2035097 | 8/1982 |

(Continued)

OTHER PUBLICATIONS

WARPIG—World and Regional Paintball Information Guide, http://www.warpig.com/paintball/technical/loaders/halo/index.shtml, WARPIG.COM, Odyssey Readies HALO for Production, by Bill Mills, Jun. 2001, pp. 1 to 5.

(Continued)

*Primary Examiner* — Gene Kim
*Assistant Examiner* — Amir Klayman
(74) *Attorney, Agent, or Firm* — Volpe and Koenig, P.C.

(57) ABSTRACT

A paintball loader having a loader body with an exit tube, and a drive assembly including a drive member that rotates about an axis and has at least one fin affixed thereto for moving a paintball toward the exit tube is provided. The drive member has an inner surface and an outer surface. A motor is provided that rotates a drive shaft. At least one first magnet is connected to the drive shaft and at least one second magnet is connected to the drive member. The at least one first magnet and the at least one second magnet have like poles arranged facing each other in a circumferential direction of the drive member about the axis, such that rotation of the drive shaft causes the first magnet to repel the second magnet, rotating the drive member.

19 Claims, 6 Drawing Sheets

U.S. PATENT DOCUMENTS

| | | | |
|---|---|---|---|
| 4,021,036 | A | 5/1977 | Nelson et al. |
| 4,034,644 | A | 7/1977 | Hupp et al. |
| 4,044,290 | A | 8/1977 | Gullo |
| 4,073,280 | A | 2/1978 | Koehn et al. |
| 4,112,911 | A | 9/1978 | Petrick, Sr. |
| 4,148,415 | A | 4/1979 | Florida et al. |
| 4,280,697 | A | 7/1981 | Yuasa |
| 4,299,383 | A | 11/1981 | Yuasa |
| 4,391,264 | A | 7/1983 | Abraham et al. |
| 4,396,193 | A | 8/1983 | Reinhardt et al. |
| 4,481,862 | A | 11/1984 | Wiethoff et al. |
| 4,487,103 | A | 12/1984 | Atchisson |
| 4,502,455 | A | 3/1985 | Stokes |
| 4,563,999 | A | 1/1986 | Miehlich |
| 4,676,137 | A | 6/1987 | Stockton et al. |
| 4,695,954 | A | 9/1987 | Rose et al. |
| 4,745,842 | A | 5/1988 | Shou-Fu |
| 4,748,600 | A | 5/1988 | Urquhart |
| 4,770,153 | A | 9/1988 | Edelman |
| 4,834,060 | A | 5/1989 | Greene |
| 4,923,066 | A | 5/1990 | Ophir et al. |
| 5,042,685 | A | 8/1991 | Moulding, Jr. et al. |
| 5,061,222 | A | 10/1991 | Suris |
| 5,070,995 | A | 12/1991 | Schaffer et al. |
| 5,233,125 | A | 8/1993 | Bouver et al. |
| 5,251,906 | A | 10/1993 | Heller et al. |
| 5,322,283 | A | 6/1994 | Ritchie et al. |
| 5,337,726 | A | 8/1994 | Wood |
| 5,464,208 | A | 11/1995 | Pierce |
| 5,497,758 | A | 3/1996 | Dobbins et al. |
| 5,505,188 | A | 4/1996 | Williams |
| 5,507,271 | A | 4/1996 | Actor |
| 5,511,333 | A | 4/1996 | Farrell |
| 5,520,171 | A | 5/1996 | David |
| 5,542,570 | A | 8/1996 | Nottingham et al. |
| 5,555,662 | A | 9/1996 | Teetzel |
| 5,561,258 | A | 10/1996 | Bentley et al. |
| 5,600,083 | A | 2/1997 | Bentley et al. |
| 5,673,812 | A | 10/1997 | Nelson |
| 5,675,110 | A | 10/1997 | Gyre et al. |
| 5,722,383 | A | 3/1998 | Tippmann |
| 5,727,538 | A | 3/1998 | Ellis |
| 5,736,720 | A | 4/1998 | Bell et al. |
| 5,749,797 | A | 5/1998 | Sunseri et al. |
| 5,755,056 | A | 5/1998 | Danner et al. |
| 5,771,875 | A | 6/1998 | Sullivan |
| 5,784,985 | A | 7/1998 | Lodico et al. |
| 5,791,325 | A | 8/1998 | Anderson |
| 5,794,606 | A | 8/1998 | Deak |
| 5,809,983 | A | 9/1998 | Stoneking |
| 5,816,232 | A | 10/1998 | Bell |
| 5,819,715 | A | 10/1998 | Haneda et al. |
| 5,836,583 | A | 11/1998 | Towers |
| 5,839,422 | A | 11/1998 | Ferris |
| 5,881,962 | A | 3/1999 | Schmidt et al. |
| 5,887,578 | A | 3/1999 | Backeris et al. |
| 5,947,100 | A | 9/1999 | Anderson |
| 5,954,042 | A | 9/1999 | Harvey |
| 6,032,395 | A | 3/2000 | Bentley et al. |
| 6,055,975 | A | 5/2000 | Gallagher et al. |
| 6,062,208 | A | 5/2000 | Seefeldt et al. |
| 6,083,105 | A | 7/2000 | Ronin et al. |
| 6,085,735 | A | 7/2000 | Cheek, Jr. |
| 6,109,252 | A | 8/2000 | Stevens |
| 6,206,562 | B1 | 3/2001 | Eyraud et al. |
| 6,213,110 | B1 | 4/2001 | Christopher et al. |
| 6,220,237 | B1 | 4/2001 | Johnson et al. |
| 6,305,367 | B1 | 10/2001 | Kotsiopoulos |
| 6,311,682 | B1 | 11/2001 | Rice et al. |
| 6,325,233 | B1 | 12/2001 | Harris |
| 6,327,953 | B1 | 12/2001 | Andresen |
| 6,347,621 | B1 | 2/2002 | Guthrie |
| 6,349,711 | B1 | 2/2002 | Perry et al. |
| 6,374,819 | B1 | 4/2002 | Ming-Hsien |
| 6,408,836 | B1 | 6/2002 | Ming-Hsien |
| 6,408,837 | B1 | 6/2002 | Johnson et al. |
| D459,767 | S | 7/2002 | Rushton |
| 6,415,781 | B1 | 7/2002 | Perrone |
| 6,418,919 | B1 | 7/2002 | Perrone |
| 6,460,530 | B1 | 10/2002 | Backeris et al. |
| 6,467,473 | B1 | 10/2002 | Kotsiopoulos |
| 6,468,879 | B1 | 10/2002 | Lamure et al. |
| 6,481,432 | B2 | 11/2002 | Rushton et al. |
| 6,488,019 | B2 | 12/2002 | Kotsiopoulos |
| 6,502,567 | B1 | 1/2003 | Christopher et al. |
| 6,526,955 | B1 | 3/2003 | Juan |
| 6,588,412 | B2 | 7/2003 | Ferrara et al. |
| 6,591,824 | B2 | 7/2003 | Hatcher |
| 6,609,511 | B2 | 8/2003 | Kotsiopoulos |
| 6,615,814 | B1 | 9/2003 | Rice et al. |
| 6,644,293 | B2 | 11/2003 | Jong |
| 6,644,295 | B2 | 11/2003 | Jones |
| 6,644,296 | B2 | 11/2003 | Gardner, Jr. |
| 6,666,203 | B2 | 12/2003 | Maeda et al. |
| 6,684,873 | B1 | 2/2004 | Anderson et al. |
| 6,701,907 | B2 | 3/2004 | Christopher et al. |
| 6,701,909 | B2 | 3/2004 | Tiberius et al. |
| 6,708,685 | B2 | 3/2004 | Masse |
| 6,722,355 | B1 | 4/2004 | Andrews, Jr. |
| 6,725,852 | B1 | 4/2004 | Yokota |
| 6,729,321 | B2 | 5/2004 | Ho |
| 6,729,497 | B2 | 5/2004 | Rice et al. |
| 6,739,322 | B2 | 5/2004 | Rice et al. |
| 6,739,323 | B2 | 5/2004 | Tippmann, Jr. |
| 6,742,512 | B1 | 6/2004 | Ho |
| 6,752,137 | B2 | 6/2004 | Brunette |
| 6,792,933 | B2 | 9/2004 | Christopher et al. |
| 6,802,306 | B1 | 10/2004 | Rice |
| 6,860,258 | B2 | 3/2005 | Farrell |
| 6,889,680 | B2 | 5/2005 | Christopher et al. |
| 6,899,328 | B2 | 5/2005 | Halliburton et al. |
| 6,915,792 | B1 | 7/2005 | Sheng |
| 6,978,776 | B2 | 12/2005 | Hamilton |
| 6,981,493 | B1 | 1/2006 | Poteracku |
| 7,000,603 | B1 | 2/2006 | Steenbeke |
| 7,017,569 | B2 | 3/2006 | Jong |
| 7,021,302 | B2 | 4/2006 | Neumaster et al. |
| 7,040,505 | B2 | 5/2006 | Hashimoto et al. |
| 7,077,118 | B2 | 7/2006 | Lewis |
| D535,339 | S | 1/2007 | Broersma |
| 7,159,585 | B2 | 1/2007 | Quinn et al. |
| 7,210,473 | B2 | 5/2007 | Jong |
| 7,216,641 | B2 | 5/2007 | Friesen et al. |
| 7,222,617 | B2 | 5/2007 | Andresen |
| D544,047 | S | 6/2007 | Bell et al. |
| 7,231,914 | B2 | 6/2007 | Hatcher |
| 7,234,456 | B2 | 6/2007 | Andresen |
| 7,270,120 | B2 | 9/2007 | Broersma et al. |
| 7,270,121 | B2 | 9/2007 | Lubben |
| 7,322,347 | B2 | 1/2008 | Broersma |
| 7,322,348 | B2 | 1/2008 | Chen |
| 7,343,909 | B2 | 3/2008 | Christopher |
| D567,302 | S | 4/2008 | Choi |
| D567,303 | S | 4/2008 | Neumaster |
| 7,357,129 | B2 | 4/2008 | Neumaster et al. |
| 7,357,130 | B2 | 4/2008 | Broersma |
| D572,318 | S | 7/2008 | Broersma |
| 7,428,899 | B2 | 9/2008 | Andresen |
| 7,441,556 | B2 | 10/2008 | Friesen et al. |
| 7,445,002 | B2 | 11/2008 | Christopher et al. |
| 7,458,370 | B2 | 12/2008 | Chen |
| D584,776 | S | 1/2009 | Stevens |
| 7,487,769 | B2 | 2/2009 | Lubben |
| 7,490,597 | B2 | 2/2009 | Hatcher |
| 7,568,478 | B2 | 8/2009 | Hedberg |
| 7,617,817 | B1 | 11/2009 | Kulp |
| 7,624,726 | B2 | 12/2009 | Wood |
| 7,654,255 | B2 | 2/2010 | Spicer |
| 7,673,627 | B2 | 3/2010 | Higgins et al. |
| 7,694,669 | B2 | 4/2010 | Campo |
| 7,762,246 | B2 | 7/2010 | Telford |
| 7,770,569 | B2 | 8/2010 | Andresen |
| 7,770,571 | B2 | 8/2010 | Tippmann, Jr. et al. |
| 7,779,825 | B2 | 8/2010 | Estrate |
| 7,832,389 | B2 | 11/2010 | Christopher |
| 7,841,328 | B2 | 11/2010 | Italia et al. |
| 2001/0029937 | A1 | 10/2001 | Hatcher |

| | | | |
|---|---|---|---|
| 2001/0039945 | A1 | 11/2001 | Rushton et al. |
| 2002/0014230 | A1 | 2/2002 | Christopher et al. |
| 2002/0020402 | A1 | 2/2002 | Kotsiopoulos |
| 2002/0059927 | A1 | 5/2002 | Woods |
| 2002/0059928 | A1 | 5/2002 | Ferrara et al. |
| 2002/0092513 | A1 | 7/2002 | Christopher et al. |
| 2002/0117159 | A1 | 8/2002 | Kotsiopoulos et al. |
| 2002/0170552 | A1 | 11/2002 | Gardner, Jr. |
| 2002/0175465 | A1 | 11/2002 | Halliburton et al. |
| 2003/0005918 | A1 | 1/2003 | Jones |
| 2003/0010330 | A1 | 1/2003 | Jong |
| 2003/0024520 | A1 | 2/2003 | Dobbins |
| 2003/0047173 | A1 | 3/2003 | Juan |
| 2003/0047174 | A1 | 3/2003 | Tiberius et al. |
| 2003/0079731 | A1 | 5/2003 | Dobbins |
| 2003/0121927 | A1 | 7/2003 | Rice et al. |
| 2003/0127084 | A1 | 7/2003 | Tippmann, Jr. |
| 2003/0127085 | A1 | 7/2003 | Brunette et al. |
| 2003/0131835 | A1 | 7/2003 | Rice et al. |
| 2003/0168052 | A1 | 9/2003 | Masse |
| 2003/0168053 | A1 | 9/2003 | Farrell |
| 2003/0188730 | A1 | 10/2003 | Maeda et al. |
| 2004/0000300 | A1 | 1/2004 | Ho |
| 2004/0074487 | A1 | 4/2004 | Christopher et al. |
| 2004/0074489 | A1 | 4/2004 | Neumaster et al. |
| 2004/0112356 | A1 | 6/2004 | Hatcher |
| 2004/0134475 | A1 | 7/2004 | Jong |
| 2004/0194772 | A1 | 10/2004 | Hamilton |
| 2004/0211402 | A1 | 10/2004 | Christopher et al. |
| 2004/0216728 | A1 | 11/2004 | Jong |
| 2004/0245276 | A1 | 12/2004 | Hashimoto et al. |
| 2005/0028801 | A1 | 2/2005 | Lewis |
| 2005/0121015 | A1 | 6/2005 | Postorivo et al. |
| 2005/0166904 | A1 | 8/2005 | Friesen et al. |
| 2005/0188974 | A1 | 9/2005 | Pedicini et al. |
| 2005/0188978 | A1 | 9/2005 | Tiberius et al. |
| 2005/0217653 | A1 | 10/2005 | Christopher et al. |
| 2005/0241628 | A1 | 11/2005 | Hatcher |
| 2005/0274370 | A1 | 12/2005 | Lubben |
| 2005/0274371 | A1 | 12/2005 | Lubben |
| 2005/0284456 | A1 | 12/2005 | Chipley |
| 2005/0284457 | A1 | 12/2005 | Hatcher |
| 2006/0005822 | A1 | 1/2006 | Quinn et al. |
| 2006/0005823 | A1 | 1/2006 | Quinn |
| 2006/0032488 | A1 | 2/2006 | Telford |
| 2006/0037597 | A1 | 2/2006 | Wood |
| 2006/0042614 | A1 | 3/2006 | Broersma |
| 2006/0054151 | A1 | 3/2006 | Christopher et al. |
| 2006/0081233 | A1 | 4/2006 | Andresen |
| 2006/0081234 | A1 | 4/2006 | Andresen |
| 2006/0086347 | A1 | 4/2006 | Hedberg |
| 2006/0124118 | A1 | 6/2006 | Dobbins |
| 2006/0130821 | A1 | 6/2006 | Hamilton |
| 2006/0157040 | A1 | 7/2006 | Broersma et al. |
| 2006/0157041 | A1 | 7/2006 | Freisen |
| 2006/0196489 | A1 | 9/2006 | Campo |
| 2006/0249131 | A1 | 11/2006 | Bromersa |
| 2006/0254572 | A1 | 11/2006 | Hall |
| 2007/0012303 | A1 | 1/2007 | Christopher et al. |
| 2007/0012304 | A1 | 1/2007 | van Dorsser et al. |
| 2007/0017494 | A1 | 1/2007 | Andresen |
| 2007/0017495 | A1 | 1/2007 | Andresen |
| 2007/0023025 | A1 | 2/2007 | Neumaster et al. |
| 2007/0056573 | A1 | 3/2007 | Campo |
| 2007/0062506 | A1 | 3/2007 | Bell |
| 2007/0101981 | A1 | 5/2007 | Chen |
| 2007/0113834 | A1 | 5/2007 | Spicer |
| 2007/0137631 | A1 | 6/2007 | Christopher |
| 2007/0175463 | A1 | 8/2007 | Higgins et al. |
| 2007/0181117 | A1 | 8/2007 | Tippmann et al. |
| 2007/0215137 | A1 | 9/2007 | Jones et al. |
| 2007/0246479 | A1 | 10/2007 | Andresen |
| 2007/0256676 | A1 | 11/2007 | Orvis et al. |
| 2008/0017178 | A1 | 1/2008 | Marques et al. |
| 2008/0047535 | A1 | 2/2008 | Handel |
| 2008/0047536 | A1 | 2/2008 | Chen |
| 2008/0047537 | A1 | 2/2008 | Kulp et al. |
| 2008/0053422 | A1 | 3/2008 | Estrate |
| 2008/0087264 | A1 | 4/2008 | Postorivo |
| 2008/0141990 | A1 | 6/2008 | Andresen |
| 2008/0178859 | A1 | 7/2008 | Moore et al. |
| 2009/0000608 | A1 | 1/2009 | Christopher et al. |
| 2009/0025700 | A1 | 1/2009 | Andresen |
| 2009/0133680 | A1 | 5/2009 | Christopher et al. |
| 2009/0241929 | A1 | 10/2009 | Italia et al. |

FOREIGN PATENT DOCUMENTS

| | | |
|---|---|---|
| DE | 3721527 | 1/1989 |
| DE | 4343870 | 6/1994 |
| DE | 4343871 | 6/1995 |
| DE | 19922589 | 12/2000 |
| EP | 0075970 | 4/1983 |
| EP | 01054228 | 11/2000 |
| EP | 01653189 | 5/2006 |
| FR | 921527 | 5/1947 |
| GB | 470201 | 8/1937 |
| GB | 551077 | 2/1943 |
| GB | 2322438 | 8/1998 |
| JP | 1179898 | 7/1989 |
| JP | 6325233 | 11/1994 |
| TW | M255391 | 1/2005 |
| WO | 9813660 | 4/1998 |
| WO | 0144745 | 6/2001 |
| WO | 0242708 | 5/2002 |
| WO | 03087698 | 10/2003 |
| WO | 07035601 | 3/2007 |
| WO | 2007033309 | 3/2007 |
| WO | 2007044546 | 4/2007 |
| WO | 2007044822 | 4/2007 |
| WO | 2008104061 | 4/2008 |
| WO | 2009/009748 | 1/2009 |

OTHER PUBLICATIONS

WARPIG—World and Regional Paintball Information Guide, http://www.warpig.com/paintball/technical/loaders/halo/review.shtml, WARPIG.COM, Odyssey HALO by Bill Mills, Dec. 2001, pp. 1 to 7.

Odyssey Halo B Paintball Hopper Review, http://www.paintball-gun-review.com/hopper-reviews/odvssey-halo-b..., Paintball Gun Review, Odyssey Halo B Paintball Hopper Review, 2004 Paintball-Gun-Review.com, pp. 1 to 4.

www.ODYSSEYPAINTBALL.com, http://web.archive.org/web/20030205112543/http://www.odysseypain..., Odyssey Paintball Products, Understanding HALO B, pp. 1 to 3.

WARPIG—World and Regional Paintball Information Guide, http://www.warpig.com/paintball/technical/loaders/evlution/evlution..., eVLution 2 Sneak Preview, by Bill Mills, Aug. 2001, pp. 1 to 4.

WARPIG—World and Regional Paintball Information Guide, http://www.warpig.com/paintball/technical/loaders/evlution/index.shtml. Brass Eagle's eVLution Loader, by Bill Mills, Aug. 2000, pp. 1-7.

WARPIG—World and Regional Paintball Information Guide, http://www.warpig.com/paintball/technical/labs/index/shtml WARPIG Ballistic Labs Report: Revolution Response Times, by Bill Mills, copyright 1992-2010, pp. 1 to 4.

U.S. Appl. No. 60/725,395, filed Oct. 11, 2005.

WARPIG—World and Regional Paintball Information Guide.http://www.warpig.com/paintball/technical/loaders/lineup WARPIG Ballistic Labs Loader Speed Comparison, by Bill Mills, Sep. 2001, 8 pages.

MAGNETIC FORCE FEED PROJECTILE FEEDER DRIVE MECHANISM

CROSS REFERENCE TO RELATED APPLICATION

This application claims the benefit of U.S. Provisional Patent Application No. 61/037,819, filed Mar. 19, 2008, which is incorporated by reference as if fully set forth.

FIELD OF THE INVENTION

This invention relates to paintball loaders, and more particularly, to a magnetic force driven drive member for use in a feed mechanism of a paintball loader that feeds paintballs into a paintball marker.

BACKGROUND

Paintball, a popular sport has developed over the years, which uses paintball markers (markers or guns), which are guns utilizing compressed gas to fire projectiles. Some examples of paintball guns are those offered under the brand names 32 DEGREES™, EMPIRE™, DIABLO™, and INDIAN CREEK DESIGNS™, and others shown and described in U.S. Pat. Nos. 6,708,685; 4,936,282; 5,497,758; and U.S. application Ser. Nos. 11/183,548; 11/180,506; 11/150,002; 11/064,693; 10/313,465; 10/090,810, the entire contents of which are all incorporated fully herein by reference. Players use the paintball guns to shoot projectiles known as paintballs (projectiles and paintballs are used interchangeably herein). These paintballs are spherical, frangible projectiles normally having gelatin or starch-based shells filled with paint (coloring or dye). The shells break when impacting a target, allowing the paint within to splatter on the target. The sport of paintball is often played like capture the flag. A player is eliminated from the game when the player is hit by a paintball fired from an opposing player's marker. When the paintball hits a target such as a player, a mark or "splat" of paint is left on the player.

Paintball loaders (otherwise known as hoppers or magazines, and also referred to herein as "paintball loaders," "loaders," or "projectile loaders") sit atop the markers and feed projectiles into the marker. These projectile loaders (the terms "hopper," "magazine," and "loader" are used interchangeably herein) store projectiles, and have an outlet or exit tube (out feed tube or neck). The outlet tube is connected to an inlet tube (or feed neck) of a paintball marker, which is in communication with the breech of the paintball marker. Thus, the loaders act to hold and feed paintball projectiles into the breech of a paintball marker, so that the projectiles can be fired from the marker.

Many loaders contain agitators or feed systems to mix, propel, or otherwise move projectiles in the loader. This mixing is performed by an impeller, projection, drive cone, agitator, paddle, arm, fin, carrier, or any other mechanism, such as those shown and described in U.S. Pat. Nos. 6,213,110; 6,502,567; 5,947,100; 5,791,325; 5,954,042; 6,109,252; 6,889,680; 6,792,933; 7,445,002; 7,343,909; Ser. Nos. 61/037,819; 11/544,443; 11/548,588; and, 12/171,956, the entire contents of all of which are incorporated by reference herein. In a "gravity feed" or "agitating" loader, an agitator mixes projectiles so that no jams occur at the exit opening of the outlet tube. In a "force feed" or "active feed" paintball loader, the agitator (drive cone, carrier, paddle or any other force feed drive system) forces projectiles through the exit tube. Because it is desirable to eliminate as many opposing players as possible, paintball markers are capable of semi-automatic rapid fire. The paintball loaders act to hold a quantity of projectiles, and ensure proper feeding of the projectiles to the marker for firing.

Modern paintball loaders utilize projections, paddles, arms, carriers, drive cones, or other agitators to mix or advance paintballs. These agitators are operated by motors, which are usually electrical, and powered by a power source such as a battery.

Paintball markers and accessories have increased in performance capability and complexity over the years. Players demand high rates of fire of paintballs from the paintball markers with little or no jamming. This has led to the development of motor driven loaders that force feed paintballs to the marker. However, existing paintball markers are limited in how fast they can accelerate to a rapid firing rate by the capability of the motor driving the paintball loader. In addition, if a loader is rapidly feeding paintballs, and the paintball marker discontinues firing, the loader must be immediately stopped, primarily through a braking mechanism which, for example, stops the rotation of a feed impeller or drive cone. Such abrupt changes in the rotation rate of the loader often result in paintball jams, and subject the paintballs to undesirable forces, which can cause breakage.

A need therefore exists for a paintball loader that efficiently converts the mechanical energy present at a high feed rate into potential energy during stopping, which can then be used by the loader during rapid startups. It would be a distinct advantage to have an apparatus that increases performance of the paintball loader by decreasing the acceleration time necessary to achieve a high rotation rate for the drive cone or feed mechanism, while decreasing the undesirable forces on the loader when stopping the rotation of the drive cone or feed mechanism. It would also be advantageous to have a mechanism that can be used repeatedly without being subject to degradation or wear. It would also be advantageous to have a mechanism that can be used in any paintball loader, enabling the feed mechanism to be easily modified by the user.

SUMMARY

The loader includes a loader body having an exit tube, and a drive assembly including a drive member that rotates about an axis and has at least one fin affixed thereto for moving a paintball toward the exit tube. The drive member has an inner surface and an outer surface. A motor is provided that rotates a drive shaft. At least one first magnet is connected to the drive shaft and at least one second magnet is connected to the drive member. The at least one first magnet and the at least one second magnet have like poles arranged facing each other in a circumferential direction of the drive member about the axis, such that rotation of the drive shaft causes the first magnet to repel the second magnet, rotating the drive member.

A paintball loader and a paintball marker combination is also disclosed. The marker has a breach with an inlet opening, and an exit tube exiting from the container is connected to the inlet opening of the marker. The loader has container that holds a plurality of paintballs, and includes a drive assembly. The drive assembly is provided with drive member that rotates about an axis with at least one fin affixed thereto for moving a paintball toward the exit tube, and motor that rotates a shaft. A first magnet is connected to the shaft and a second magnet is connected to the drive member. The first and second magnets have like poles arranged facing each other in a circumferential direction of the drive member, such that rotation of the shaft causes the first magnet to repel the second magnet, rotating the drive member. Also provided is a controller that controls actuation of the motor based on a firing demand, and at least one input connected to the controller that senses a firing demand.

A method for accelerating a feed mechanism in a paintball loader of a paintball marker is also disclosed. According to the method, a loader including a drive motor connected to a shaft having a first magnet attached thereto is provided, as well as a drive member having a second magnet attached thereto. The first and second magnets are oriented such a pole of the second magnet faces a like pole of the first magnet. A trigger of the marker is squeezed, to activate the marker. Upon a firing demand, the drive member is rotated with potential energy generated by repulsion between the first and the second magnets.

BRIEF DESCRIPTION OF THE DRAWINGS

The invention will be better understood and its numerous advantages will become more apparent to those skilled in the art by reference to the following drawings, in conjunction with the accompanying specification, in which.

DETAILED DESCRIPTION OF THE EMBODIMENTS

As used herein, the terms "feeder," "feed mechanism," or "impeller" refer to any apparatus that impels, moves, pushes, agitates, or otherwise mixes projectiles within a loader or hopper, such as an agitator, arms, fins, paddles, paddle arms, spokes, drive cones, carriers, including, but not limited to, those shown and described in U.S. Pat. Nos. 6,213,110; 6,502,567; 5,947,100; 5,791,325; 5,954,042; 6,109,252; 6,889,680; and 6,792,933, the entire contents of which are incorporated by reference herein, and those used in commercially available paintball loaders such as the various HALO® brand paintball loaders, the EMPIRE RELOADER™ paintball loaders, and substitutes or equivalents thereof.

Figure 1:
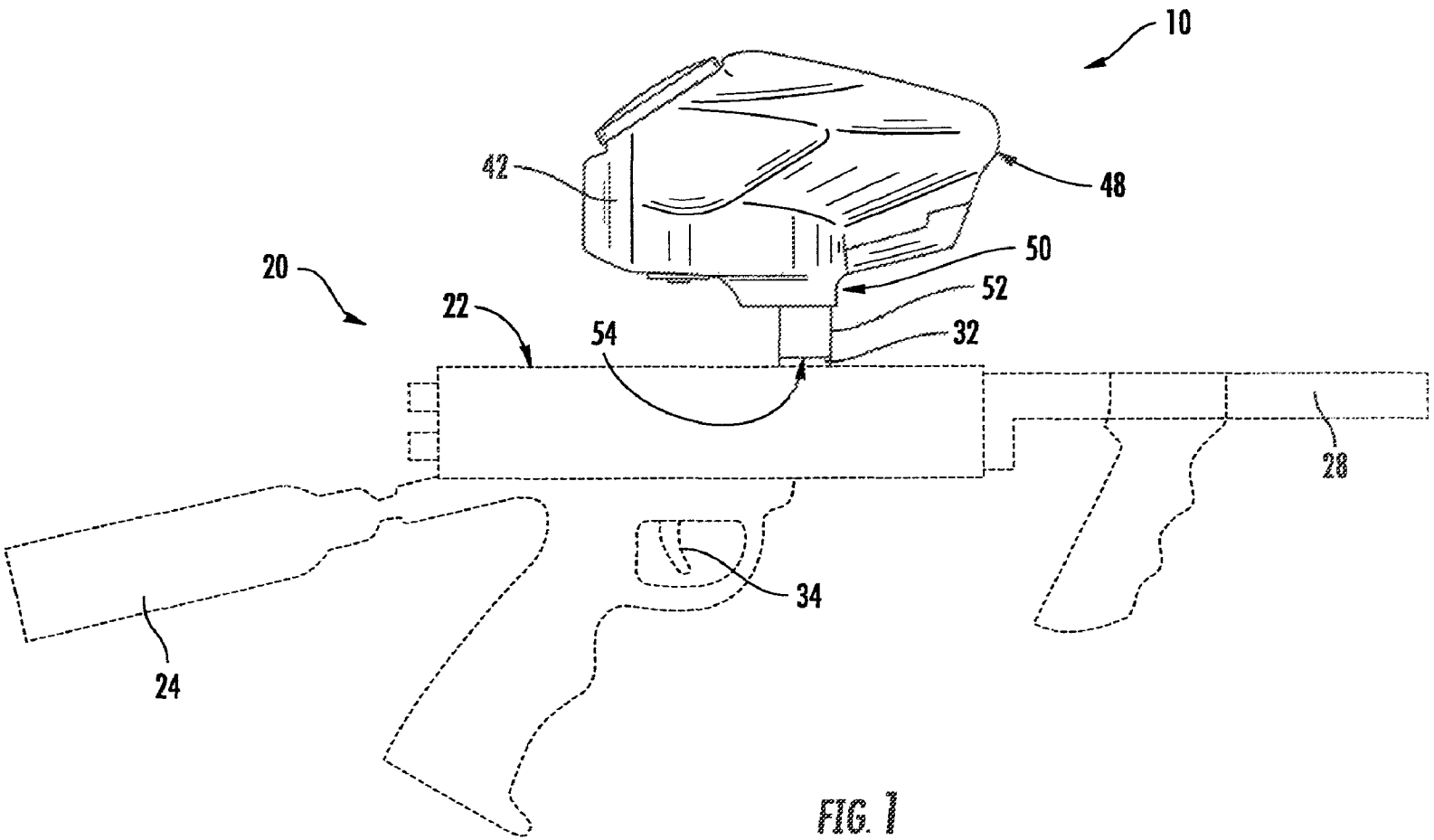
FIG. 1 is a side elevational view of a paintball loader constructed in accordance with the teachings of the present invention and operatively attached to a representative paintball marker, illustrated in phantom.

FIGS. 1-6 illustrate a paintball loader 10 for use with a paintball marker 20. As shown in FIG. 1, the paintball loader 10 is attached to a paintball marker 20, illustrated in phantom. The paintball marker 20 includes an inlet tube 32 leading to a firing chamber (not shown) in the interior of the main body 22. In operating the paintball marker 20, paintballs 68 (shown in FIGS. 3 and 4) are continually fed by the paintball loader 10 through the inlet tube 32 to the firing chamber. The paintball marker 20 can be automatic or semi-automatic. The loader 10 includes a paintball container 42 that is divided into an upper portion 48 and a lower portion 50. An exit tube 52 having an entry opening 74 leads from the lower portion 50 of the container to an outlet opening 54. The exit tube 52 is positioned on top of the inlet tube 32 of the paintball marker 20, and has a cylindrical shape with an inside diameter slightly larger than that of a conventional paintball 68.

Figure 2:
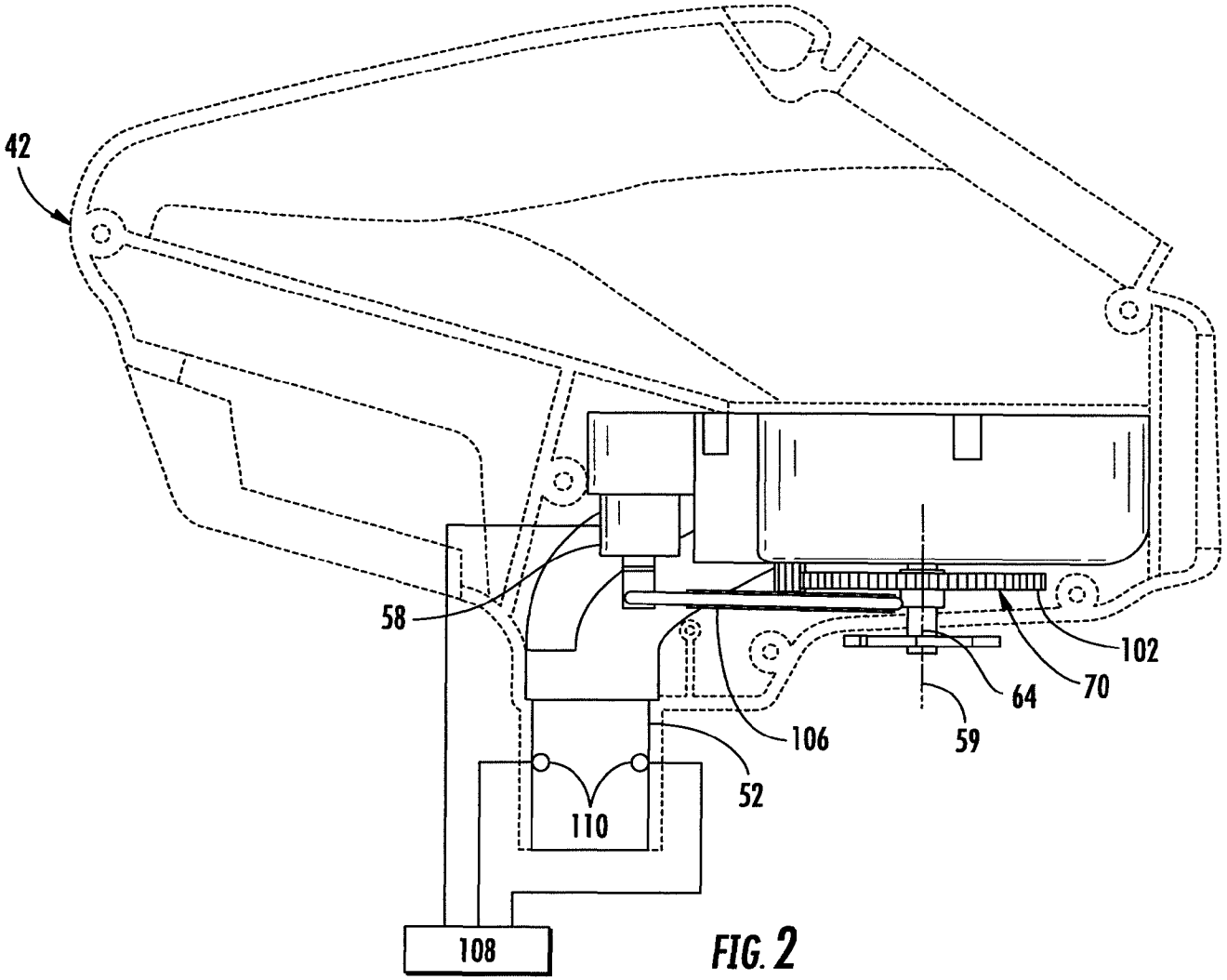
FIG. 2 is a side cut-away view of the paintball loader of FIG. 1, illustrating the loader housing in phantom.

FIG. 2 is side cut-away view of the paintball loader 10 of FIG. 1, illustrating the loader container 42 in phantom. A motor 58 is provided for driving the loader 10. A controller 108 is connected to at least one sensor 110 (two sensors are illustrated FIG. 2) that detects the presence of paintballs 68 in the exit tube 52. The controller 108 can be a microprocessor, and the sensors 110 are preferably positioned in the exit tube 52 of the paintball loader 10 to detect either the presence or absence of paintballs 68 within the exit tube 52, and relay that information to the microprocessor 108 for controlling operation of the motor 58. The sensors 110 can alternatively be positioned in other areas such as the inlet tube 32. The microprocessor 108 is in communication with the motor 58, so that when the sensor 110 detects either the presence or absence of paintballs 68 within the exit tube 52, the microprocessor 108 receives a signal. If paintballs 68 are present in the exit tube 52, the microprocessor 108 preferably sends a signal to turn the motor 58 off. When the sensor 110 does not detect any paintballs 68 within the exit tube 52, the microprocessor 108 can then signal an actuation of the motor 58, providing additional paintballs 68 to the inlet tube 32 of the paintball marker 20. It should be understood that any acceptable sensors 110 may be utilized to detect paintballs, such as optical or infrared sensors, a contact pad, an actuator switch, etc., without departing from the scope of the present invention. In one preferred embodiment, a reflective infrared (IR) optical sensor (not shown) may be utilized.

Figure 3:
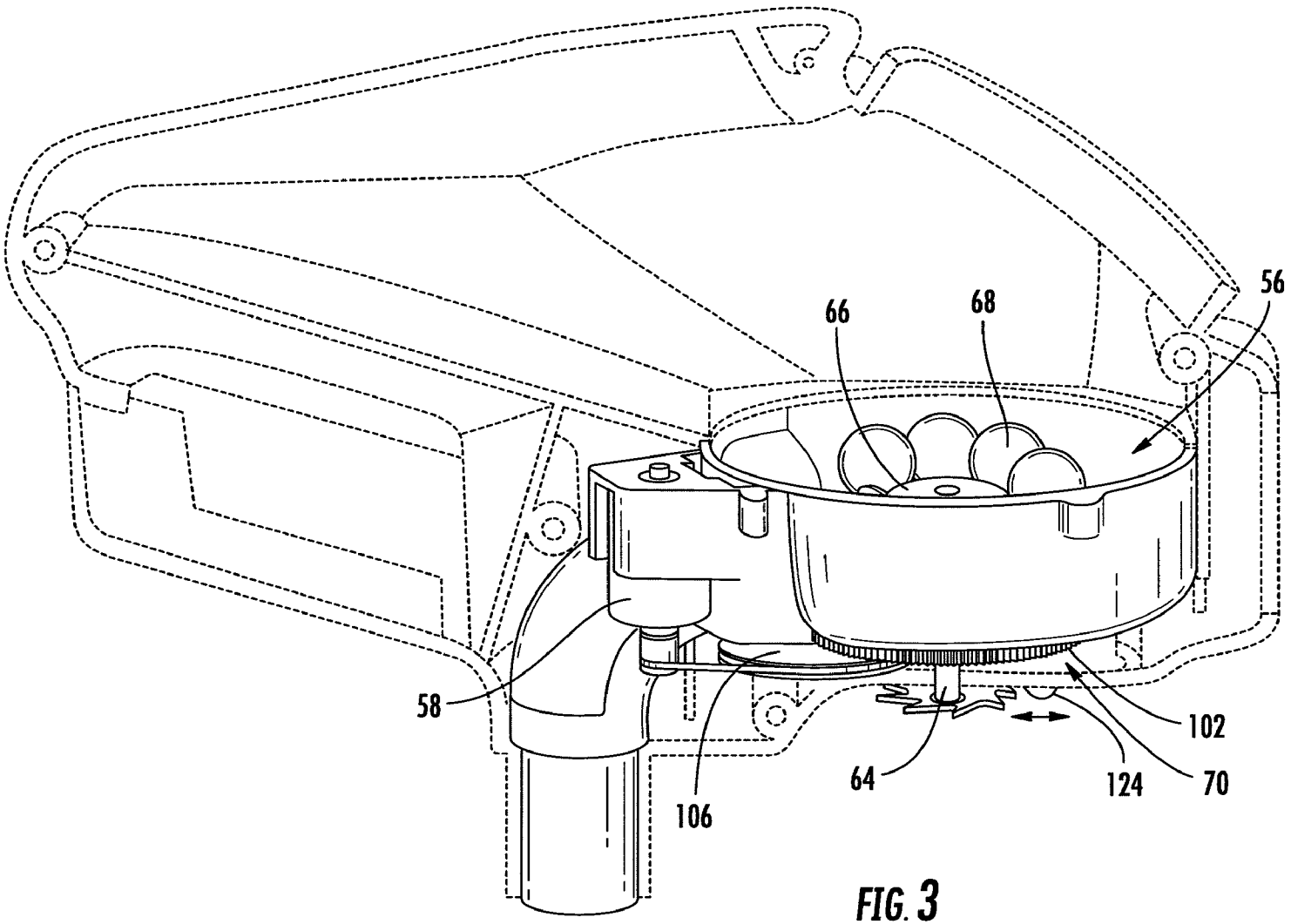
FIG. 3 is a side cut-away perspective view of the paintball loader of FIG. 1, illustrating the loader housing in phantom.
Figure 4:
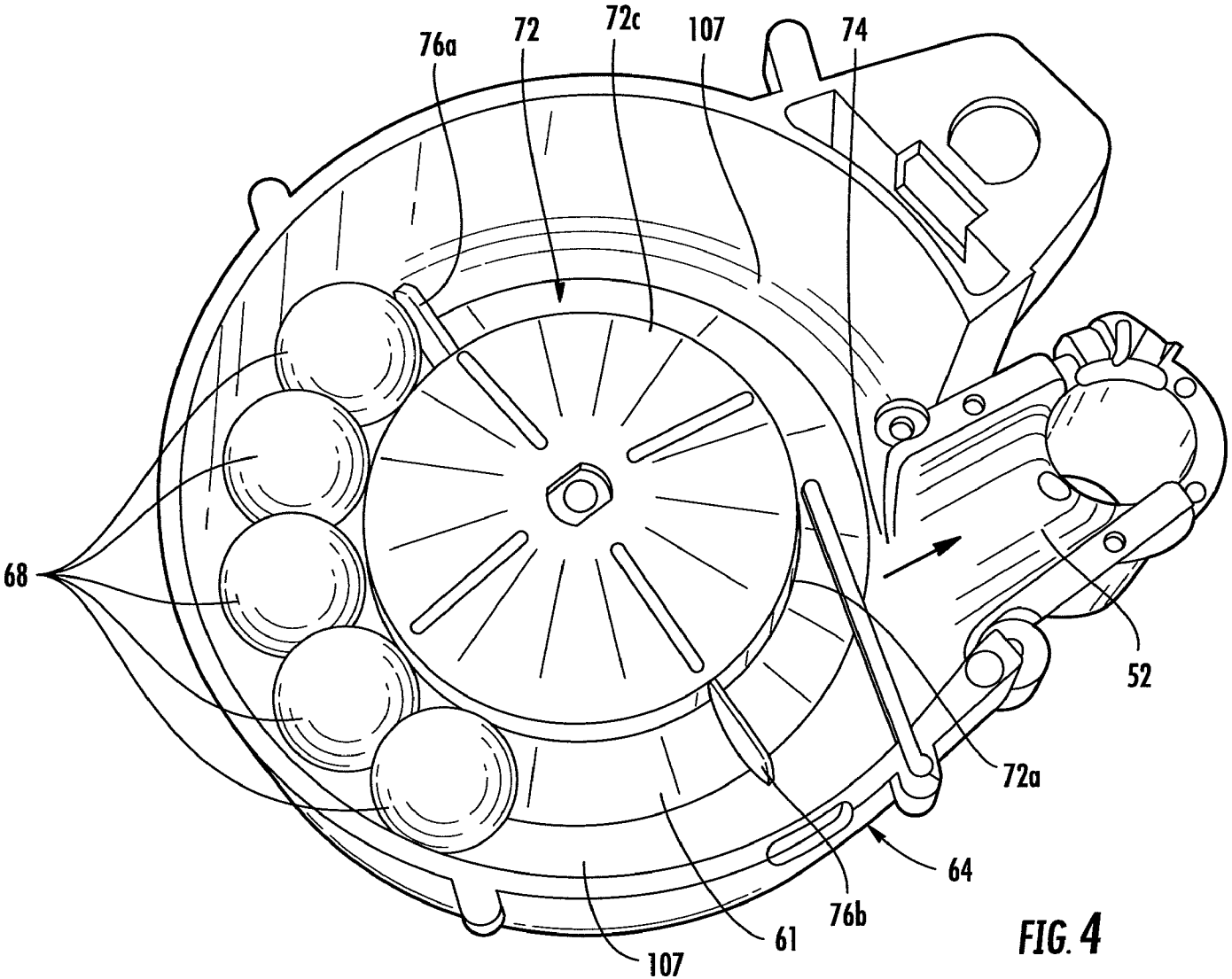
FIG. 4 is a top interior cutaway view of the paintball loader of FIG. 1 illustrating the top of the drive cone, the exit tube, and a plurality of paintballs.

FIGS. 3 and 4 provide a partial top view and a top interior cutaway view of the paintball loader 10. The loader 10 has a drive assembly 70 with an agitation device, such as a drive cone 72, shown in FIGS. 4-6. The drive cone 72 has an outer surface 72*a*, an inner surface 72*b*, and a top surface 72*c*. The top surface 72*c* slopes downward from center axis 59 of the drive cone 72. At least one fin 76*a* is affixed to a top surface 72*c* of the drive cone 72. If more than one fin 76*a*, 76*b* is provided, gaps 107 are formed between adjacent fins 76*a*, 76*b*. The gaps 107 are large enough to accommodate at least one paintball 68. In the illustrated embodiment, a plurality of paintballs 68 will fit in each of the gaps 107. The container is also adapted to store a plurality of paintballs 68 prior to being used by the paintball marker 20. However, the drive cone 72 may be sized to accommodate any number of paintballs 68.

Figure 5:
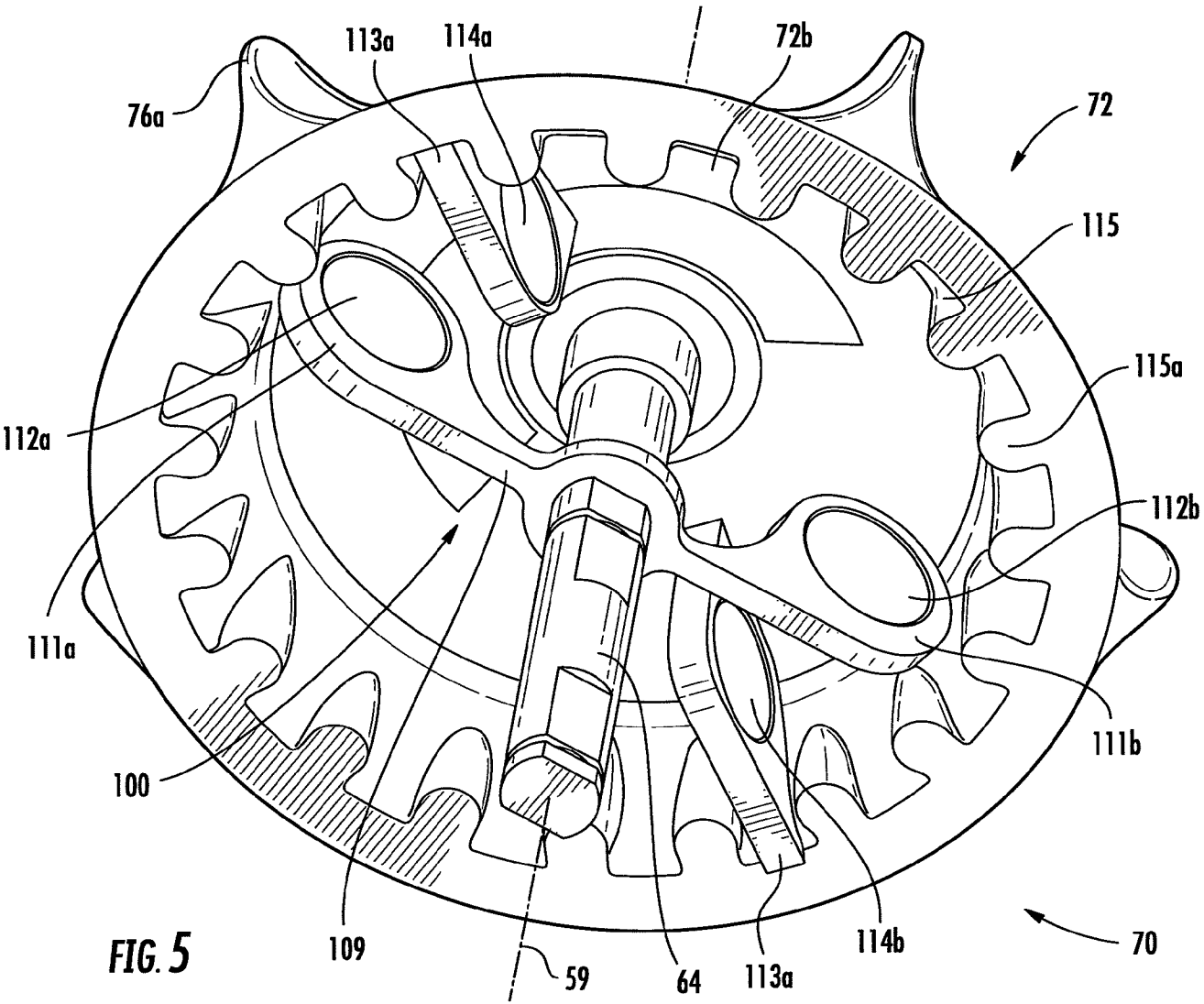
FIG. 5. is a bottom perspective view of the drive cone of FIG. 1.
Figure 6:
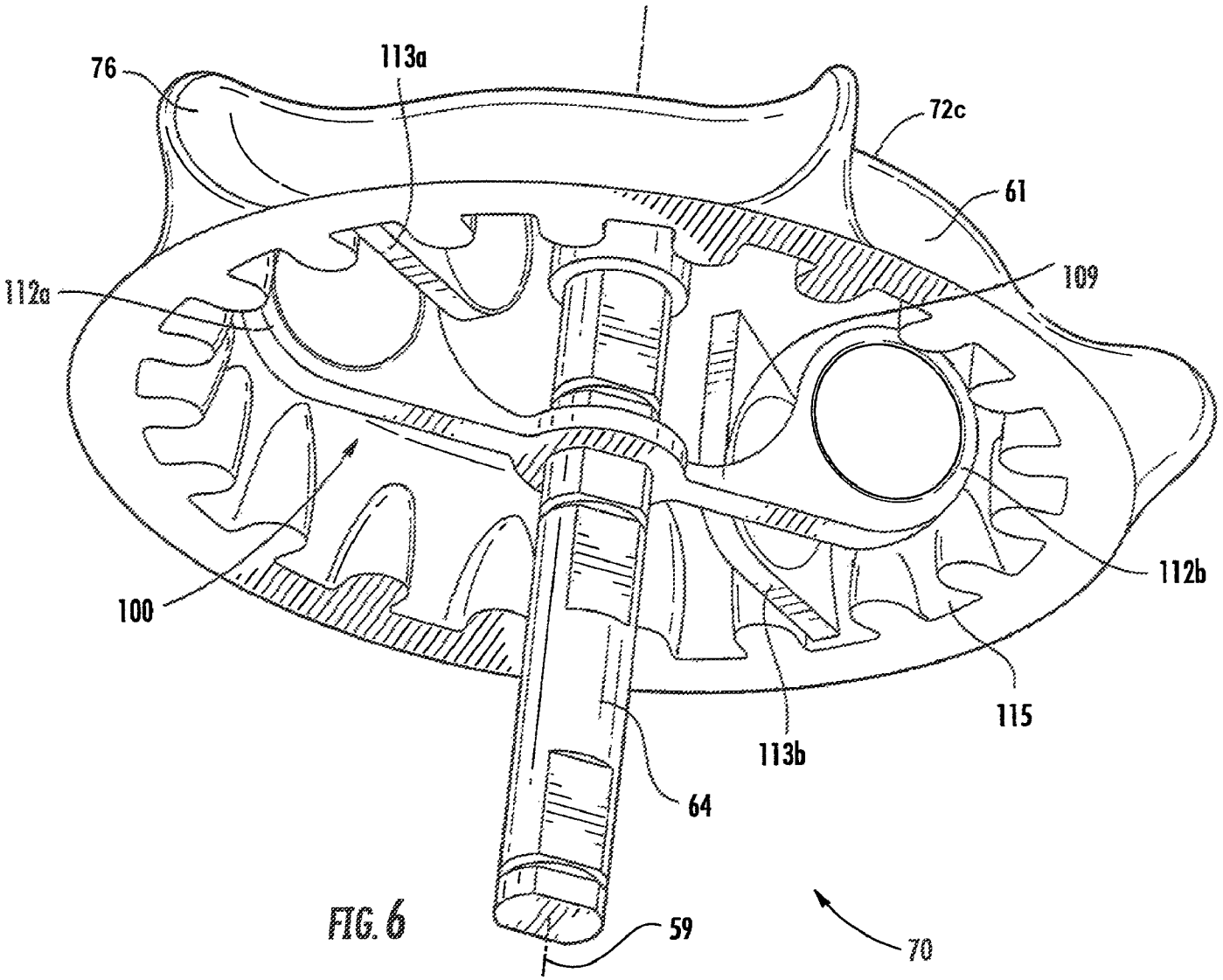
FIG. 6. is a bottom perspective view of the drive cone of FIG. 1, taken from a different angle from that of FIG. 5.

As shown in FIGS. 5 and 6, a plurality of teeth 115 project inwardly from the inner surface 72*b* of the drive cone 72. The teeth 115 are separated by spaces 115*a*.

Referring back to FIGS. 2 and 3, the drive assembly 70 also includes a shaft 64. The loader motor 58 is connected to this shaft 64 in order to selectively rotate the shaft 64 via a belt and/or reduction gear drive train 102, 106 around the center axis 59, as shown in FIG. 2. The drive cone 72 is rotatably supported on top of the drive shaft 64.

It should be understood that the drive cone 72 may have any number of fins 76*a* which allows the accommodation of at least one paintball 68 within each formed gap 107. In addition to the drive cone 72, any type of impeller or drive member can be used which are known from a wide variety of paintball loaders.

As shown in FIG. 4, a feed surface 61 of the drive cone 72, extends between adjacent fins 76, where the paintballs 68 are stored prior to firing of the marker 20. The feed surface 61 is preferably sloped downward (approximately 45 degrees in the embodiment shown). The surface 61 can be sloped at any angle that allows paintballs 68 to feed into the exit tube 52.

FIGS. 5 and 6 show bottom perspective views of the drive cone 72 and the magnetic drive 100 of the loader drive assembly 70. The magnetic drive 100 includes at least one first or drive magnet 112*a*, 112*b* connected to the drive shaft 64, and at least one second or drive magnet 112*a*, 112*b* connected to the inner surface of the drive cone 72. Preferably, a perpendicular cross member 109 is fixed to the shaft 64 and thus pivots around axis 59 with the shaft 64. The cross member 109 has at least one, and preferably two paddles 111*a*, 111*b*, attached at opposite ends thereof. The drive magnets 112*a*, 112*b* are connected to the paddles 111*a*, 111*b*.

At least one, and preferably two counter paddles 113*a*, 113*b*, are located on or formed with the inner surface 72*b* of the drive cone 72. The counter paddles 113*a*, 113*b* each carry a second, or drive magnet 114*a*, 114*b*. The counter paddles 113*a*, 113*b* of the preferred embodiment are formed separately from the drive cone 72 and are affixed within the spaces 115*a* formed between adjacent teeth 115. Each space 115*a* is sized to hold one counter paddle 113*a*, 113*b*. The counter paddles 113*a*, 113*b* may be permanently and integrally fixed within the spaces 115*a* in the inner surface 72*b* between the adjacent teeth 115, such as through a molded or bonded connection, or can be integrally formed with the drive cone 72. The counter paddles 113*a*, 113*b* may alternatively be detachably connected to the inner surface 72*b* through, for example, a snap, keyed or other releasable connection. This permits the paddles 113*a*, 113*b* to be moved to different positions between teeth 115 anywhere around the circumference of the drive cone 72, if desired.

Preferably, the drive magnets 112*a*, 112*b* are each affixed to a distal end of a respective paddle 111*a*, 111*b*, at a distance R from the axis around which the shaft rotates. The driven magnets 114*a*, 114*b* on the counter paddles 113*a*, 113*b* are similarly arranged at a distance from the axis 59 such that the drive magnets 112*a*, 112*b* and the driven magnets 114*a*, 114*b* are circumferentially aligned. The magnets 112*a*, 112*b*; 114*a*, 114*b* on the paddles 111*a*, 111*b* and the counter paddles 113*a*, 113*b* are arranged with like poles facing one another in a circumferential direction. While the preferred embodiment shows magnets 112*a*, 112*b*, 114*a*, 114*b* on two paddles 111*a*, 111*b* and two counter paddles 113*a*, 113*b*, respectively, the magnetic drive 100 could alternatively have a single pair of opposing magnets, three, or even more opposing pairs of paddle and counter paddle magnets.

The counter paddles 113*a*, 113*b* with the driven magnets 114*a*, 114*b* act together with the drive magnets 112*a*, 112*b* to provide a driving rotational magnetic force. For example, as the shaft paddle 111*a*, 111*b* mounted drive magnets 112*a*, 112*b* approach the like facing pole of the counter paddle 113*a*, 113*b* mounted driven magnets 114*a*, 114*b*, the two like poles repel one another, forming a repelling magnetomotive force between the magnets. This is multiplied by the number of magnet pairs utilized. This repulsion force is exerted in the drive direction of the drive shaft 64, and pushes the drive cone 72 forward as the motor 58 rotates the drive shaft 64.

The preferred embodiment has two pairs of magnets that are equally circumferentially spaced apart, so that both pairs provide a generally equal force. However, the spacing of one or more of the magnets could be varied to provide a smaller initial force.

The magnets used may vary in type, size, or shape. For example, disk-shaped permanent magnets made of ceramic, ferrite, alnico, injection molded, flexible, rare earth, SMMs, and SCMs may be used. The range of possible types, sizes, and shape designs permits the magnetomotive force between the magnets to be set to any desired range.

The present invention also provides a method for immediate acceleration of a feed mechanism for a paintball marker 20 upon a firing demand occurring for the loader 10 as provided above. When an operator of the paintball marker 20 wishes to shoot paintballs 68, the trigger 34 is squeezed, actuating a compressed gas cylinder 24 which releases bursts of compressed gas to eject paintballs 68 through the barrel 28. A plurality of paintballs 68 stored in the paintball container 42 pass down the exit tube 52 for use by the paintball marker 20 when demanded by the operator. As some of the plurality of paintballs 68 located in the container 42 rest on top of the drive cone 72, the bottom-most paintballs 68 drop into the gaps 107. The method for immediate acceleration of the feed mechanism is accomplished when the marker trigger 34 is squeezed to fire the paintball 68, creating an immediate demand for a paintball 68 at the marker inlet tube 32. The at least one first or drive magnet 112*a*, 112*b* of the feed mechanism is located in a potential energy storing position in close proximity to the at least one second or driven magnet 114*a*, 114*b*, with the potential energy stored being a function of the strength of the magnets and the proximity of the like poles of the first and second magnets 112*a*, 112*b*, 114*a*, 114*b*. This stored potential energy is released when the ball stack in the exit tube 52 moves due to the firing demand (i.e., balls entering the firing chamber and being discharged), rotating the drive member or drive cone 72 to feed another ball at the same time. The firing demand is detected by the sensors 110, or otherwise conveyed to the loader controller 108, for example by an RF trigger signal from the marker, activating the loader motor 58 to rotate the shaft 64 so that the at least one first magnet 112*a*, 112*b* is rotated counter clockwise toward the at least one second magnet 114*a*, 114*b*, continuing the rotation of the drive cone or drive member 72 as long as the firing demand continues.

By utilizing opposing magnets 112*a*, 112*b*; 114*a*, 114*b*, the rotation of the feed mechanism 56 is not required to be immediately stopped, when the firing demand stops, as detected by the sensors 110, or via other means, such as the discontinuance of a trigger signal, and in some cases it is desirable to over-run the motor 58 of a pre-determined increment in order to store potential energy for the next firing demand. The system can be used repeatedly without wear or fatigue of the energy storage mechanism, unlike mechanical springs. In addition, the acceleration rate of the feed mechanism is nearly instantly available when the second or driven magnet 114*a*, 114 *b* is released due to the stack of paintballs 68 in the exit tube 52 moving when there is a firing demand, which is possible even before the sensor to control the motor 58 signals for actuation of the drive assembly 70. Thus, the performance of the loader 10 is enhanced, and the reliability is also improved.

Additionally, as paintballs 68 vacate the exit tube 52, the sensor 110 does not detect the presence of a paintball 68 and continues to engage the motor 58 and the drive cone 72 continues to be rotated by the drive motor 58 via the magnetic drive 100, forcing the paintballs 68 outward and downward and forward toward the tube extension (not shown), as the motor 58 runs.

In this way, the exit tube 52 is always kept full of paintballs 68, ready for use when demanded by the paintball marker 20. When the sensor 110 no longer detects movement of the paintballs 68, the controller 108 stops the motor actuator.

In contrast to a feed mechanism employing a braking mechanism to immediately stop the rotation, as the drive cone 72 stops turning due to the paintball stack in the exit tube 52 preventing further movement, the shaft 64 can continue to rotate for a short angular distance, pushing the at least one pair of magnets 112*a*, 114*a* together to store potential energy created during the deceleration of the feed mechanism 56. The potential energy due to the magnetic repulsion force of the like poles (positive-positive or negative-negative) is stored by the drive assembly 70. This stored energy may then be utilized to rapidly start the rotation of the feed mechanism 56 when the operator then desires to commence firing paintballs 68 from the marker 20.

The first and second magnets 112*a*, 114*a* thus assist in spinning the drive cone 72 prior to and during motor 58 start-up to the required rotational speed. The movement of the paintballs 68 from the exit tube 52 into the marker breech allows the instantaneous release of the magnetic force prior to or in addition to the rotation of the drive cone 72. The loader motor 58 is preferably activated either by a trigger signal or sensor 110 in the exit tube 52 and rotates the feed mechanism.

The magnetic drive 100 according to the invention can be utilized by any agitator or drive cone assembly for a paintball loader 10, which are generally referred to as a "drive member." Although a simple magnet pair is illustrated and described above, the specific configuration is but one of many different configurations which utilize a pair of magnets to store mechanical energy. Although paddles with magnets are described, it should be understood that any magnetic device may be utilized which stores the rotational energy during the deceleration of the feed mechanism of the paintball loader, as well as releasing the stored energy by allowing the magnet to assist in increasing the acceleration rate of the feed mechanism during commencement of rapid fire of the paintball marker.

While the apparatus shown and described has been characterized as being preferred, it will be readily apparent that various changes and modifications could be made therein without departing from the scope of the invention as defined in the following claims.

What is claimed is:

1. A paintball loader comprising:

a loader body having an exit tube;

a drive assembly including a drive member that rotates about an axis and has at least one fin affixed thereto for moving a paintball toward the exit tube, the drive member having an inner surface and an outer surface, and a motor that rotates a drive shaft; and at least one first magnet, having a first polarity, connected to the drive shaft and at least one second magnet, having the same polarity as the at least one first magnet, connected to the drive member, the at least one first magnet and the at least one second magnet arranged in a circumferential direction of the drive member about the axis, such that rotation of the drive shaft causes the at least one first magnet to be brought in proximity to the at least one second magnet, causing the at least one magnet to repel the at least one second magnet, thereby providing a force to rotate the drive member to move a paintball toward the exit tube.

2. The loader of claim 1, further comprising a controller that controls actuation of the motor based on a firing demand of the paintball loader.

3. The loader of claim 2, wherein the motor is adapted to continue to rotate the drive shaft after the firing demand ceases, and the drive member stops rotating, forcing the at least one first magnet toward the at least one second magnet to store potential energy.

4. The loader of claim 1, wherein a magnetomotive force between the at least one first magnet and the at least one second magnet is a function of a strength and proximity of the magnets.

5. The loader of claim 1, wherein the at least one first magnet and the at least one second magnet comprise permanent magnets.

6. The loader of claim 5, wherein the at least one first magnet and the at least one second magnet are permanent magnets selected from the group consisting of ceramic, ferrite, alnico, injection molded, flexible, rare earth, SMMs, and SCMs.

7. The loader of claim 1, wherein the at least one first magnet comprises a plurality of evenly spaced drive magnets connected to the drive shaft, and the at least one second magnet comprises a plurality of evenly spaced driven magnets connected to the drive member.

8. The paintball loader of claim 7, wherein the drive magnets are circumferentially aligned with the driven magnets.

9. The loader of claim 1, wherein the at least one second magnet is located on at least one counter paddle integrally affixed to the inner surface between adjacent teeth located on the drive member through a molded or bonded connection.

10. The loader of claim 1, wherein the at least one second magnet is located on at least one counter paddle detachably affixed to the inner surface between adjacent teeth located on the drive member.

11. The loader of claim 10, wherein a position of the at least one counter paddle is adjustable on the drive member.

12. The loader of claim 1, wherein the drive member is positioned over the drive shaft and the at least one first and second magnets are pushed together as the drive member rotationally decelerates, and the at least one first and second magnets assist in a rotational acceleration of the drive shaft by repelling from one another prior to or during initiation of the rotation of the drive shaft.

13. The loader of claim 2, wherein the controller further comprises a microprocessor that actuates the motor and is in communication with a sensor for detecting the presence of a paintball.

14. The loader of claim 2, further comprising at least one sensor connected to the controller that senses a firing demand.

15. A paintball loader and a paintball marker combination comprising:

a marker having a breach with an inlet opening;

an exit tube exiting from a bottom portion a paintball loader and connected to the inlet opening of the marker; and the paintball loader having container that holds a plurality of paintballs, and a drive assembly comprising:

a drive member that rotates about an axis with at least one fin affixed thereto for moving a paint ball toward the exit tube;

a motor that rotates a shaft;

a first magnet connected to the shaft and a second magnet connected to the drive member, the first and second magnets having identical polarities arranged in a circumferential direction of the drive member, such that rotation of the shaft causes the first magnet to be brought in proximity to the at least one second magnet, causing the at least one first magnet to repel the second magnet, thereby providing a force to rotate the drive member to move a paintball toward the exit tube;

a controller that controls actuation of the motor based on a firing demand; and at least one input connected to the controller that senses a firing demand.

16. The loader of claim 15, wherein the drive member is positioned over the shaft and the first and second magnets assist in a rotational acceleration of the shaft by repelling one another prior to or during initiation of the rotation of the shaft.

17. The paintball loader of claim 16, wherein a microprocessor activates the motor and is in communication with the sensor for detecting the presence of a paintball.

18. The paintball loader of claim 17, wherein the second magnet is circumferentially aligned with the first magnet.

19. A method for accelerating a feed mechanism in a paintball loader for a paintball marker, comprising:

providing a loader comprising, an exit tube, a drive motor connected to a shaft having a first magnet attached thereto, and a drive member having a second magnet attached thereto, the first and second magnets having the same polarity;

orienting the first and second magnets such that the second magnet faces the first magnet; and squeezing a trigger of the marker to activate the drive motor;

upon a firing demand, rotating the drive member, with potential energy generated by repulsion force between the first magnet and the second magnet, to move a paintball toward the exit tube.

* * * * *